US011957166B2

(12) United States Patent
Lee et al.

(10) Patent No.: US 11,957,166 B2
(45) Date of Patent: Apr. 16, 2024

(54) CARTRIDGE AND AEROSOL GENERATING DEVICE INCLUDING THE SAME

(71) Applicant: KT&G CORPORATION, Daejeon (KR)

(72) Inventors: Jong Sub Lee, Seongnam-si (KR); Kyung Moon Ji, Anyang-si (KR)

(73) Assignee: KT&G CORPORATION, Daejeon (KR)

( * ) Notice: Subject to any disclaimer, the term of this patent is extended or adjusted under 35 U.S.C. 154(b) by 826 days.

(21) Appl. No.: 16/969,321

(22) PCT Filed: Apr. 22, 2020

(86) PCT No.: PCT/KR2020/005299
§ 371 (c)(1),
(2) Date: Aug. 12, 2020

(87) PCT Pub. No.: WO2020/218811
PCT Pub. Date: Oct. 29, 2020

(65) Prior Publication Data

US 2022/0369707 A1 Nov. 24, 2022

(30) Foreign Application Priority Data

Apr. 23, 2019 (KR) ..... 10-2019-0047522

(51) Int. Cl.
*A24F 40/42* (2020.01)
*A24F 40/10* (2020.01)
(Continued)

(52) U.S. Cl.
CPC ..... *A24F 40/42* (2020.01); *A24F 40/10* (2020.01); *A24F 40/46* (2020.01); *A24F 40/51* (2020.01)

(58) Field of Classification Search
None
See application file for complete search history.

(56) References Cited

U.S. PATENT DOCUMENTS 9,427,023 B2 8/2016 Liu
10,609,960 B2 4/2020 Deng et al.
(Continued)

FOREIGN PATENT DOCUMENTS

CN 103315398 A 9/2013
CN 104323433 A 2/2015
(Continued)

OTHER PUBLICATIONS

International Search Report dated Oct. 14, 2020, in International Application No. PCT/KR2020/005299.
(Continued)

*Primary Examiner* — Oscar C Jimenez
(74) *Attorney, Agent, or Firm* — Sughrue Mion, PLLC

(57) ABSTRACT

A cartridge for an aerosol generating device is provided, which includes a storage configured to store an aerosol generating material; a heating element configured to generate aerosol by heating the aerosol generating material; an aerosol discharge passage configured to discharge the aerosol in one direction; and a cap coupled to one end of the storage to seal the storage; and a droplet accommodation portion formed in the cap and located on an extension line of the aerosol discharge passage to accommodate droplets formed from the aerosol.

14 Claims, 7 Drawing Sheets

(51) Int. Cl.
*A24F 40/46* (2020.01)
*A24F 40/51* (2020.01)

(56) References Cited

U.S. PATENT DOCUMENTS

| | | | | |
|---|---|---|---|---|
| 2012/0199663 | A1* | 8/2012 | Qiu | A24F 40/42 239/8 |
| 2013/0306064 | A1 | 11/2013 | Thorens et al. | |
| 2016/0029698 | A1 | 2/2016 | Xiang | |
| 2016/0374399 | A1 | 12/2016 | Monsees et al. | |
| 2017/0064999 | A1* | 3/2017 | Perez | B65D 85/54 |
| 2017/0079330 | A1 | 3/2017 | Mironov et al. | |
| 2017/0258134 | A1 | 9/2017 | Kane | |
| 2017/0301898 | A1* | 10/2017 | Lin | A24F 40/40 |
| 2017/0360096 | A1 | 12/2017 | Silvestrini | |
| 2018/0014573 | A1 | 1/2018 | Silvestrini | |
| 2018/0020736 | A1 | 1/2018 | Silvestrini et al. | |
| 2019/0116872 | A1* | 4/2019 | Qiu | A24D 3/18 |
| 2019/0335813 | A1* | 11/2019 | Qiu | A24F 40/485 |
| 2020/0367556 | A1* | 11/2020 | Lin | A24F 40/42 |
| 2020/0397049 | A1 | 12/2020 | Silvestrini et al. | |
| 2021/0106059 | A1* | 4/2021 | Wang | A24F 40/485 |
| 2022/0202086 | A1* | 6/2022 | Zhou | A24F 40/46 |

FOREIGN PATENT DOCUMENTS

| | | | |
|---|---|---|---|
| CN | 20488744 | U | 12/2015 |
| CN | 207653563 | U | 7/2018 |
| CN | 108968159 | A | 12/2018 |
| CN | 208370946 | U | 1/2019 |
| CN | 109475190 | A | 3/2019 |
| CN | 109480338 | A | 3/2019 |
| KR | 1020130139296 | A | 12/2013 |
| KR | 1020160130342 | A | 11/2016 |
| KR | 1020170008209 | A | 1/2017 |
| KR | 1020170086128 | A | 7/2017 |
| KR | 10-2018-0028953 | A | 3/2018 |
| WO | 2016/015265 | A1 | 2/2016 |
| WO | 2018/210681 | A2 | 11/2018 |

OTHER PUBLICATIONS

Extended European Search Report dated May 10, 2022 in European Application No. 20739834.8.
Office Action dated Mar. 23, 2023 in Chinese Application No. 202080001244.5.
Notice of Reasons for Refusal dated Sep. 28, 2021 from the Japanese Patent Office in Japanese Application No. 2020-543589.
Decision to Refuse issued in the China National Intellectual Property Adminstration in corresponding CN Patent Application No. 202080001244.5 dated Feb. 2, 2024.

* cited by examiner

CARTRIDGE AND AEROSOL GENERATING DEVICE INCLUDING THE SAME

CROSS REFERENCE TO RELATED APPLICATIONS

This application is a National Stage of International Application No. PCT/KR2020/005299 filed Apr. 22, 2020, claiming priority based on Korean Patent Application No. 10-2019-0047522 filed Apr. 23, 2019.

TECHNICAL FIELD

One or more embodiments relate to a cartridge and an aerosol generating device including the same.

BACKGROUND ART

Recently, the demand for alternative methods to overcome the shortcomings of general cigarettes has increased. For example, there is a growing demand for a method of generating aerosol by heating an aerosol generating material in cigarettes or liquid storages, rather than by combusting cigarettes. Accordingly, studies on a heating-type aerosol generating device have been actively conducted.

In general, an aerosol generating material is liquid, so the aerosol generating material and droplets formed from aerosol are likely to leak during a vaporizing process. Therefore, an effective solution for leakage is required.

DISCLOSURE

Technical Solution

According to one or more embodiments, a cartridge includes a storage configured to store an aerosol generating material; a heating element configured to generate aerosol by heating the aerosol generating material; an aerosol discharge passage configured to discharge the aerosol in one direction; a cap coupled to one end of the storage to seal the storage; and a droplet accommodation portion formed in the cap and located on an extension line of the aerosol discharge passage to accommodate droplets formed from the aerosol.

Advantageous Effects

According to one or more embodiments, droplets may be collected by a droplet accommodation portion and prevented from leaking out of a cartridge.

Effects by embodiments are not limited to the effects described above, and unmentioned effects may be clearly understood from the present specification and the appended claims by those of ordinary skill in the art.

BEST MODE

Figure 1:
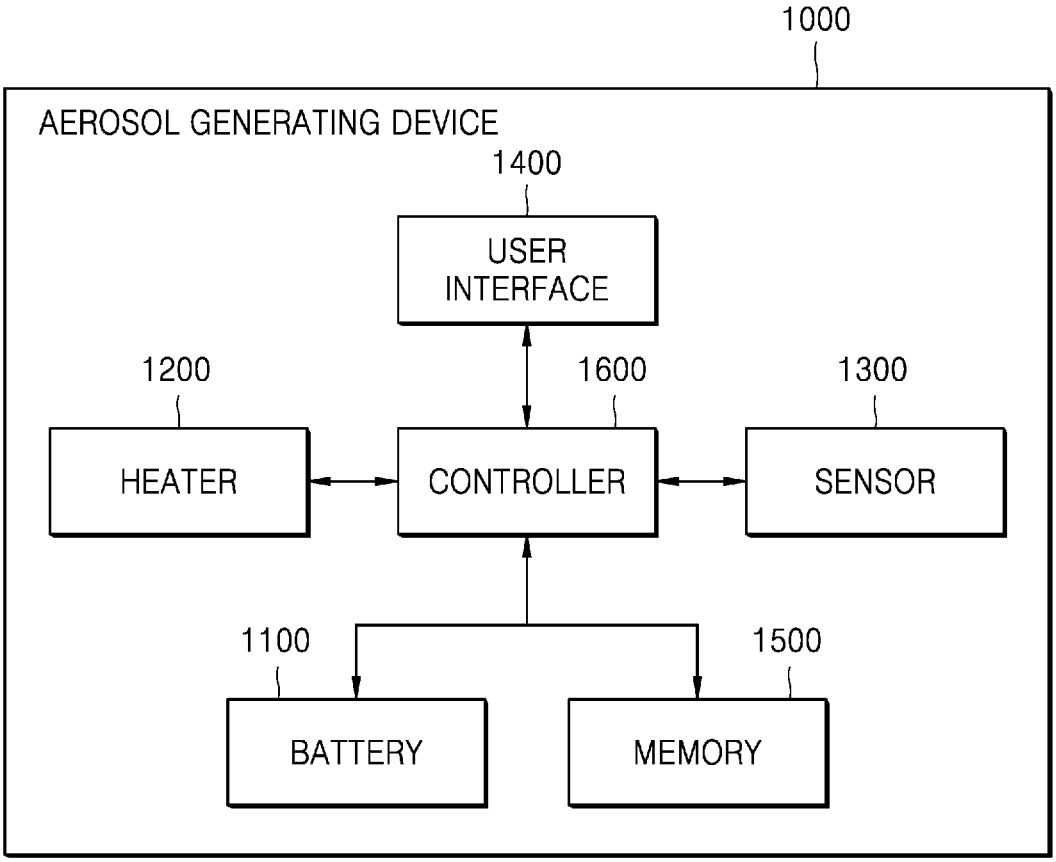
FIG. 1 is a block diagram illustrating a hardware configuration of an aerosol generating device according to an embodiment.

According to one or more embodiments, a cartridge includes a storage configured to store an aerosol generating material; a heating element configured to generate aerosol by heating the aerosol generating material; an aerosol discharge passage configured to discharge the aerosol in one direction; a cap coupled to one end of the storage to seal the storage; and a droplet accommodation portion formed in the cap and located on an extension line of the aerosol discharge passage to accommodate droplets formed from the aerosol.

The cap may include an air inflow passage configured to introduce external air into the cartridge through at least one inlet, wherein the at least one inlet is spaced apart from the extension line.

The air inflow passage may include a first path introducing the external air in the one direction and a second path introducing the external air introduced into the first path in different direction from the one direction.

The droplet accommodation portion may include a sidewall and a bottom wall, wherein one end of the first path extending into the cartridge is spaced apart from the bottom wall in the one direction.

The at least one inlet is arranged on both sides of the extension line.

The droplet accommodation portion may include a first recessed portion recessed by a first depth in the one direction to accommodate the droplets.

The droplet accommodation portion may include a second recessed portion recessed by a second depth greater than the first depth in the one direction to accommodate the droplets.

The second recessed portion may be formed at a center of the droplet accommodation portion.

According to one or more embodiments, an aerosol generating device includes a cartridge including a storage configured to store an aerosol generating material; a heating element configured to generate aerosol by heating the aerosol generating material; an aerosol discharge passage configured to discharge the aerosol in one direction; a cap configured to seal the storage; and an droplet accommodation portion formed in the cap and located on an extension line of the aerosol discharge passage; and a battery configured to supply power to the cartridge; and a controller configured to control the power supplied by the power to the cartridge.

The cap may include an air inflow passage introducing external air into the cartridge through an inlet, wherein the inlet is spaced apart from the extension line of the aerosol discharge passage.

The droplet accommodation portion may include a first recessed portion recessed by a first depth in the one direction and a second recessed portion recessed by a second depth greater than the first depth in the one direction.

MODE FOR INVENTION

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

Throughout the specification, an "aerosol generating article" may refer to a material capable of generating an aerosol, such as a tobacco (cigarette) or a cigar. The aerosol generating article may include an aerosol generating material or an aerosol forming substrate. Also, the aerosol generating article may include a solid material on the basis of a tobacco raw material such as a reconstituent tobacco sheet, a pipe tobacco, or a reconstituted tobacco. Aerosols may include volatile compounds.

Also, throughout the specification, "upstream" or "forward" refers to a direction away from a mouth of a user smoking the aerosol generating article, and "downstream" or "backward" refers to a direction closer to the mouth of the user smoking the aerosol generating article.

Hereinafter, the present disclosure will now be described more fully with reference to the accompanying drawings, in which example embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

FIG. 1 is a block diagram illustrating hardware components of the aerosol generating device according to an embodiment.

Referring to FIG. 1, the aerosol generating device 1000 may include a battery 1100, a heater 1200, a sensor 1300, a user interface 1400, a memory 1500, and a controller 1600. However, the internal structure of the aerosol generating device 1000 is not limited to the structures illustrated in FIG. 1. Also, it will be understood by one of ordinary skill in the art that some of the hardware components shown in FIG. 1 may be omitted or new components may be added according to the design of the aerosol generating device 1000.

In an embodiment where the aerosol generating device 1000 includes a main body without a cartridge, the components shown in FIG. 1 may be located in the main body. In another embodiment where the aerosol generating device 1000 includes a main body and a cartridge, the components shown in FIG. 1 may be located in the main body and/or the cartridge.

The battery 1100 supplies electric power to be used for the aerosol generating device 1000 to operate. For example, the battery 1100 may supply power such that the heater 1200 may be heated. In addition, the battery 1100 may supply power required for operation of other components of the aerosol generating device 1000, such as the sensor 1300, the user interface 1400, the memory 1500, and the controller 1600. The battery 1100 may be a rechargeable battery or a disposable battery. For example, the battery 1100 may be a lithium polymer (LiPoly) battery, but is not limited thereto.

The heater 1200 receives power from the battery 1100 under the control of the controller 1600. The heater 1200 may receive power from the battery 1100 and heat a cigarette inserted into the aerosol generating device 1000, or heat the cartridge mounted on the aerosol generating device 1000.

The heater 1200 may be located in the main body of the aerosol generating device 1000. Alternatively, the heater 1200 may be located in the cartridge. When the heater 1200 is located in the cartridge, the heater 1200 may receive power from the battery 1100 located in the main body and/or the cartridge.

The heater 1200 may be formed of any suitable electrically resistive material. For example, the suitable electrically resistive material may be a metal or a metal alloy including titanium, zirconium, tantalum, platinum, nickel, cobalt, chromium, hafnium, niobium, molybdenum, tungsten, tin, gallium, manganese, iron, copper, stainless steel, or nichrome, but is not limited thereto. In addition, the heater 1200 may be implemented by a metal wire, a metal plate on which an electrically conductive track is arranged, or a ceramic heating element, but is not limited thereto.

In an embodiment, the heater 1200 may be included in the cartridge. The cartridge may include the heater 1200, the liquid delivery element, and the liquid storage. The aerosol generating material accommodated in the liquid storage may be absorbed by the liquid delivery element, and the heater 1200 may heat the aerosol generating material absorbed by the liquid delivery element, thereby generating aerosol. For example, the heater 1200 may include a material such as nickel or chromium and may be wound around or arranged adjacent to the liquid delivery element.

Meanwhile, the heater 1200 may include an induction heater. The heater 1200 may include an electrically conductive coil for heating a cigarette or the cartridge by an induction heating method, and the cigarette or the cartridge may include a susceptor which may be heated by the induction heater.

The aerosol generating device 1000 may include at least one sensor 1300. A result sensed by the sensor 1300 is transmitted to the controller 1600, and the controller 1600 may control the aerosol generating device 1000 by controlling the operation of the heater, restricting smoking, determining whether a cigarette (or a cartridge) is inserted, displaying a notification, etc.

For example, the sensor 1300 may include a puff detecting sensor. The puff detecting sensor may detect a user's puff based on a temperature change, a flow change, a voltage change, and/or a pressure change.

In addition, the at least one sensor 1300 may include a temperature sensor. The temperature sensor may detect a temperature of the heater 1200 (or an aerosol generating material). The aerosol generating device 1000 may include a separate temperature sensor for sensing a temperature of the heater 1200, or the heater 1200 itself may serve as a temperature sensor without a separate temperature sensor. Alternatively, a separate temperature sensor may be further included in the aerosol generating device 1000 while the heater 1200 serves as a temperature sensor.

The sensor 1300 may include a position change detecting sensor. The position change detecting sensor may detect a change in a position of the slider which is coupled to the main body and slides along the main body.

The user interface 1400 may provide the user with information about the state of the aerosol generating device 1000. For example, the user interface 1400 may include various interfacing devices, such as a display or a light emitter for outputting visual information, a motor for outputting haptic information, a speaker for outputting sound information, input/output (I/O) interfacing devices (for example, a button or a touch screen) for receiving information input from the user or outputting information to the user, terminals for performing data communication or receiving charging power, and/or communication interfacing modules for performing wireless communication (for example, Wi-Fi, Wi-Fi direct, Bluetooth, near-field communication (NFC), etc.) with external devices.

The memory 1500 may store various data processed or to be processed by the controller 1600. The memory 1500 may include various types of memories, such as dynamic random access memory (DRAM), static random access memory (SRAM), read-only memory (ROM), electrically erasable programmable read-only memory (EEPROM), etc.

The memory 1500 may store an operation time of the aerosol generating device 1000, the maximum number of puffs, the current number of puffs, at least one temperature profile, data on a user's smoking pattern, etc.

The controller 1600 may control overall operations of the aerosol generating device 1000. The controller 1600 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The controller 1600 analyzes a result of the sensing by the sensor 1300, and controls processes that are to be performed subsequently.

The controller 1600 may control power supplied to the heater 1200 so that the operation of the heater 1200 is started or terminated, based on the result of the sensing by the sensor 1300. In addition, based on the result of the sensing by the sensor 1300, the controller 1600 may control the amount of power supplied to the heater 1200 and the time at which the power is supplied, so that the heater 1200 is heated to a predetermined temperature or maintained at an appropriate temperature.

In an embodiment, the controller 1600 may set a mode of the heater 1200 to a pre-heating mode to start the operation of the heater 1200 after receiving a user input to the aerosol generating device 1000. In addition, the controller 1600 may switch the mode of the heater 1200 from the pre-heating mode to an operation mode after detecting a user's puff by using the puff detecting sensor. In addition, the controller 1600 may stop supplying power to the heater 1200 when the number of puffs reaches a preset number after counting the number of puffs by using the puff detecting sensor.

The controller 1600 may control the user interface 1400 based on the result of the sensing by the at least one sensor 1300. For example, when the number of puffs counted by the puff detecting sensor reaches a preset number, the controller 1600 may notify the user by using the user interface 14000 (e.g., a light emitter, a motor, a speaker, etc.) that the aerosol generating device 1000 will soon be terminated.

Although not illustrated in FIG. 1, the aerosol generating device 1000 may be combined with a separate cradle to form an aerosol generating system. For example, the cradle may be used to charge the battery 1100 of the aerosol generating device 1000. For example, the aerosol generating device 1000 may be supplied with power from a battery of the cradle to charge the battery 1100 of the aerosol generating device 1000 while being accommodated in an accommodation space of the cradle.

Figure 2:
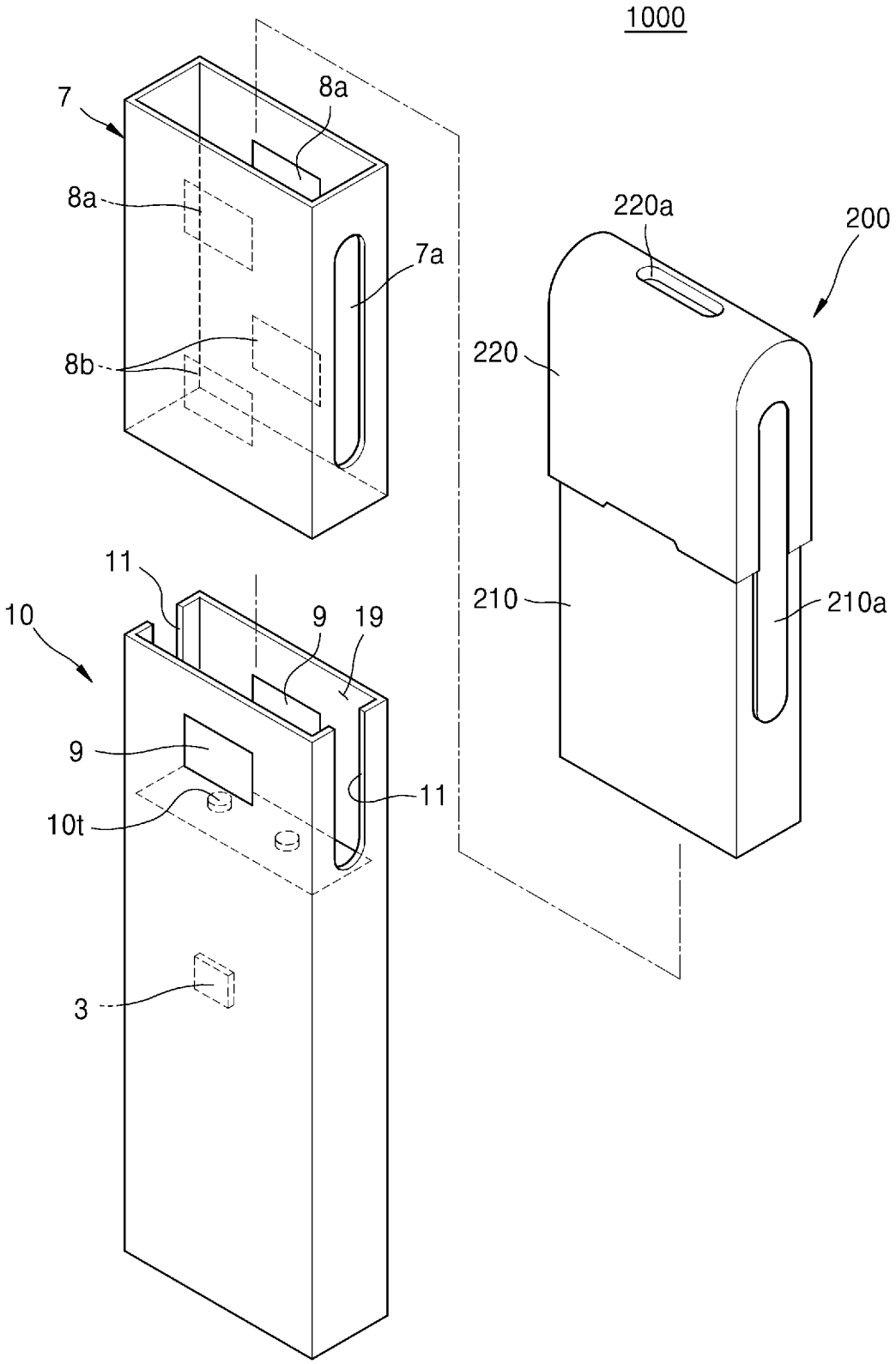
FIG. 2 is a schematic exploded perspective view illustrating a coupling relationship between a replaceable cartridge including an aerosol generating material and an aerosol generating device including the same, according to an embodiment.

FIG. 2 is an exploded perspective view schematically illustrating a coupling relationship between a replaceable cartridge containing an aerosol generating material and an aerosol generating device including the same, according to an embodiment.

An aerosol generating device 1000 according to the embodiment illustrated in FIG. 2 includes the cartridge 200 containing the aerosol generating material and a main body 10 supporting the cartridge 200.

The cartridge 200 containing the aerosol generating material may be coupled to the main body 10. A portion of the cartridge 200 may be inserted into an accommodation space 19 of the main body 10 so that the cartridge 200 may be mounted on the main body 10.

The cartridge 200 may contain an aerosol generating material at least in one of, for example, a liquid state, a solid state, a gaseous state, or a gel state. The aerosol generating material may include a liquid composition. For example, the liquid composition may be a liquid including a tobacco-containing material having a volatile tobacco flavor component, or a liquid including a non-tobacco material.

For example, the liquid composition may include one component of water, solvents, ethanol, plant extracts, spices, flavorings, and vitamin mixtures, or a mixture of these components. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. In addition, the liquid composition may include an aerosol forming agent such as glycerin and propylene glycol.

For example, the liquid composition may include any weight ratio of glycerin and propylene glycol solution to which nicotine salts are added. The liquid composition may include two or more types of nicotine salts. Nicotine salts may be formed by adding suitable acids, including organic or inorganic acids, to nicotine. Nicotine may be a naturally generated nicotine or synthetic nicotine and may have any suitable weight concentration relative to the total solution weight of the liquid composition.

Acid for the formation of the nicotine salts may be appropriately selected in consideration of the rate of nicotine absorption in the blood, the operating temperature of the aerosol generating device 1000, the flavor or savor, the solubility, or the like. For example, the acid for the formation of nicotine salts may be a single acid selected from the group consisting of benzoic acid, lactic acid, salicylic acid, lauric acid, sorbic acid, levulinic acid, pyruvic acid, formic acid, acetic acid, propionic acid, butyric acid, valeric acid, caproic acid, caprylic acid, capric acid, citric acid, myristic acid, palmitic acid, stearic acid, oleic acid, linoleic acid, linolenic acid, phenylacetic acid, tartaric acid, succinic acid, fumaric acid, gluconic acid, saccharic acid, malonic acid, and malic acid, or may be a mixture of two or more acids selected from the above-described group, but is not limited thereto.

The cartridge 200 is operated by an electrical signal or a wireless signal transmitted from the main body 10 to perform a function of generating aerosol by converting the phase of the aerosol generating material inside the cartridge 200 to a gaseous phase. The aerosol may refer to a gas in which vaporized particles generated from an aerosol generating material are mixed with air.

For example, in response to receiving the electrical signal from the main body 10, the cartridge 200 may convert the phase of the aerosol generating material by heating the aerosol generating material by, for example, an ultrasonic vibration method or an induction heating method. In an embodiment, the cartridge 200 may include its own power source and generate aerosol based on an electric control signal or a wireless signal received from the main body 10.

The cartridge 200 may include a liquid storage 210 accommodating the aerosol generating material therein, and an atomizer performing a function of converting the aerosol generating material of the liquid storage 210 to aerosol.

When the liquid storage 210 "accommodates the aerosol generating material" therein, it means that the liquid storage 210 functions as a container simply holding an aerosol generating material and that the liquid storage 210 includes therein an element impregnated with (i.e., containing) an aerosol generating material, such as a sponge, cotton, fabric, or porous ceramic structure.

The atomizer may include, for example, a liquid delivery element (e.g, wick) for absorbing the aerosol generating material and maintaining the same in an optimal state for conversion to aerosol, and a heater heating the liquid delivery element to generate aerosol. Across the descriptions, the term liquid delivery element, wick may be used interchangeably.

The liquid delivery element may include at least one of, for example, a cotton fiber, a ceramic fiber, a glass fiber, and porous ceramic.

The heater may include a metallic material such as copper, nickel, tungsten, or the like to heat the aerosol generating material delivered to the liquid delivery element by generating heat using electrical resistance. The heater may be implemented by, for example, a metal wire, a metal plate, a ceramic heating element, or the like. Also, the heater may be implemented by a conductive filament using a material such as a nichrome wire, and may be wound around or arranged adjacent to the liquid delivery element.

In addition, the atomizer may be implemented by a heating element in the form of a mesh or plate, which absorbs the aerosol generating material, maintains it in an optimal state for conversion to aerosol, and generates aerosol by heating the aerosol generating material. In this case, a separate liquid delivery element may not be required.

At least a portion of the liquid storage 210 of the cartridge 200 may include a transparent portion so that the aerosol generating material accommodated in the cartridge 200 may be visually identified from the outside. The liquid storage 210 may include a protruding window 210*a* protruding from the liquid storage 210, so that the liquid storage 210 may be inserted into a groove 11 of the main body 10 when coupled to the main body 10. A mouthpiece 220 and/or the liquid storage 210 may be entirely formed of transparent plastic or glass. Alternatively, only the protruding window 210*a* may be formed of a transparent material.

The main body 10 includes a connection terminal 10*t* arranged inside the accommodation space 19. When the liquid storage 210 of the cartridge 200 is inserted into the accommodation space 19 of the main body 10, the main body 10 may provide power to the cartridge 200 or supply a signal related to an operation of the cartridge 200 to the cartridge 200, through the connection terminal 10*t*.

The mouthpiece 220 is coupled to one end of the liquid storage 210 of the cartridge 200. The mouthpiece 220 is a portion of the aerosol generating device 1000, which is to be inserted into a user's mouth. The mouthpiece 220 includes a discharge hole 220*a* for discharging aerosol generated from the aerosol generating material inside the liquid storage 210 to the outside.

The aerosol generating device 1000 may include at least one air passage through which external air may be introduced. For example, the air passage may be a space formed between the accommodation space 19 of the main body 10 and an end of the cartridge 200 coupled to the main body 10. The external air introduced through the air passage may be discharged through the mouthpiece 220 after passing through the cartridge 200. For example, a user may open or close the air passage, and adjust a size of the air passage. Accordingly, the amount and quality of the smoke may be adjusted by the user.

The slider 7 is coupled to the main body 10 to move with respect to the main body 10. The slider 7 covers or exposes at least a portion of the mouthpiece 220 of the cartridge 200 coupled to the main body 10 by moving with respect to the main body 10. The slider 7 includes an elongated hole 7*a* exposing at least a portion of the protruding window 210*a* of the cartridge 200 to the outside.

As shown FIG. 2, the slider 7 may have a shape of a hollow container with both ends opened, but the structure of the slider 7 is not limited thereto. For example, the slider 7 may have a bent plate structure having a clip-shaped cross-section, which is movable with respect to the main body 10 while being coupled to an edge of the main body 10. In another example, the slider 7 may have a curved semi-cylindrical shape having a curved arc-shaped cross section.

The slider 7 may include a magnetic body for maintaining the position of the slider 7 with respect to the main body 10 and the cartridge 200. The magnetic body may include a permanent magnet or a material such as iron, nickel, cobalt, or an alloy thereof.

The magnetic body may include two first magnetic bodies 8*a* facing each other, and two second magnetic bodies 8*b* facing each other. The first magnetic bodies 8*a* are arranged to be spaced apart from the second magnetic bodies 8*b* in a longitudinal direction of the main body 10 (i.e., the direction in which the main body 10 extends), which is a moving direction of the slider 7.

The main body 10 includes a fixed magnetic body 9 arranged on a path along which the first magnetic bodies 8*a* and the second magnetic bodies 8*b* of the slider 7 move as the slider 7 moves with respect to the main body 10. Two fixed magnetic bodies 9 of the main body 10 may be mounted to face each other with the accommodation space 19 therebetween.

The slider 7 may be stably maintained in positions where an end of the mouthpiece 220 is covered or exposed, by magnetic force acting between the fixed magnetic body 9 and the first magnetic body 8*a* or between the fixed magnetic body 9 and the second magnetic body 8*b*.

The main body 10 includes a position change detecting sensor 3 arranged on the path along which the first magnetic body 8*a* and the second magnetic body 8*b* of the slider 7 move as the slider 7 moves with respect to the main body 10. The position change detecting sensor 3 may include, for example, a Hall integrated circuit (IC) using the Hall effect to detect a change in a magnetic field, and may generate a signal based on the detected change.

In the aerosol generating device 1000 according to the above-described embodiments, the main body 10, the cartridge 200, and the slider 7 have approximately rectangular cross-sectional shapes when viewed in the longitudinal direction, but in the embodiments, the shape of the aerosol generating device 1000 is not limited. The aerosol generating device 1000 may have, for example, a cross-sectional shape of a circle, an ellipse, a square, or a polygon of various shapes. In addition, the aerosol generating device 1000 is not necessarily limited to a structure that extends linearly, and may be curved in a streamlined shape or bent at a preset angle to be easily held by the user.

Figure 3:
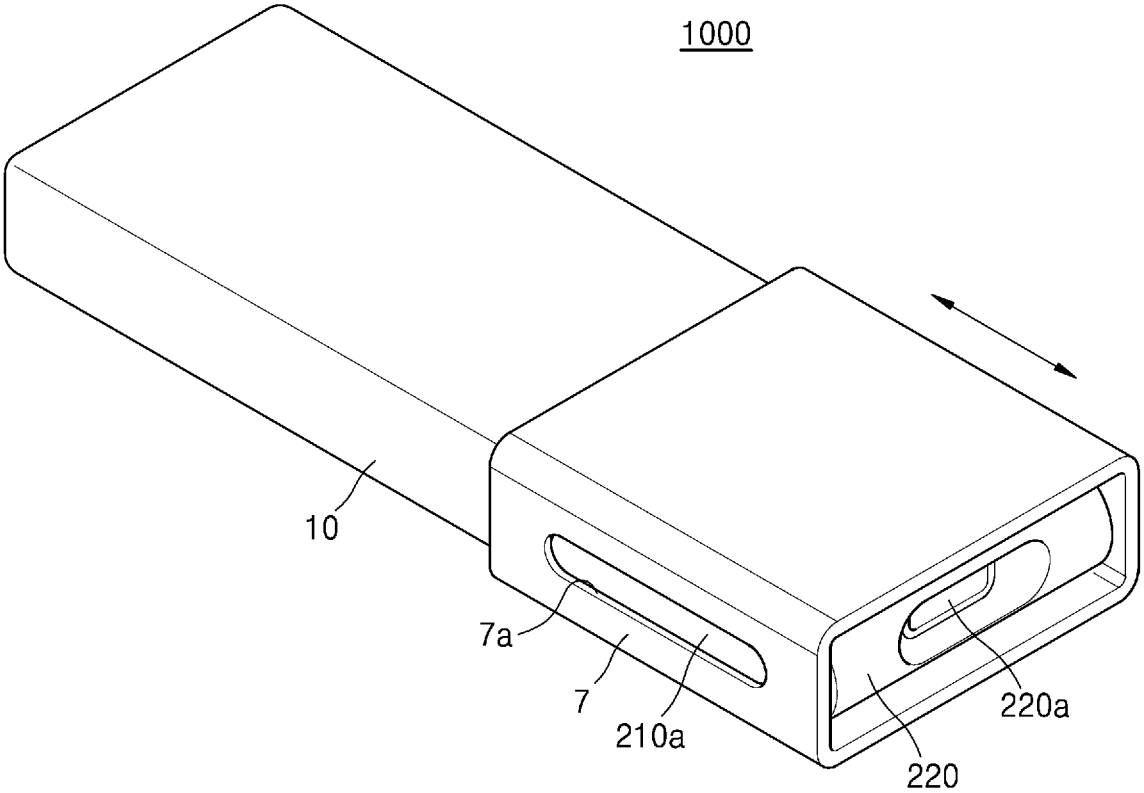
FIG. 3 is a perspective view illustrating an example operation state of the aerosol generating device according to the embodiment illustrated in FIG. 2.

FIG. 3 is a perspective view of an example operating state of the aerosol generating device according to the embodiment illustrated in FIG. 2.

In FIG. 3, the slider 7 is at a position where the end of the mouthpiece 220 of the cartridge coupled to the main body 10 is covered. In this state, the mouthpiece 220 may be safely protected from external impurities and kept clean.

The user may check the remaining amount of aerosol generating material contained in the cartridge by visually checking the protruding window 210*a* of the cartridge through the elongated hole 7*a* of the slider 7. The user may move the slider 7 in the longitudinal direction of the main body 10 to use the aerosol generating device 1000.

Figure 4:
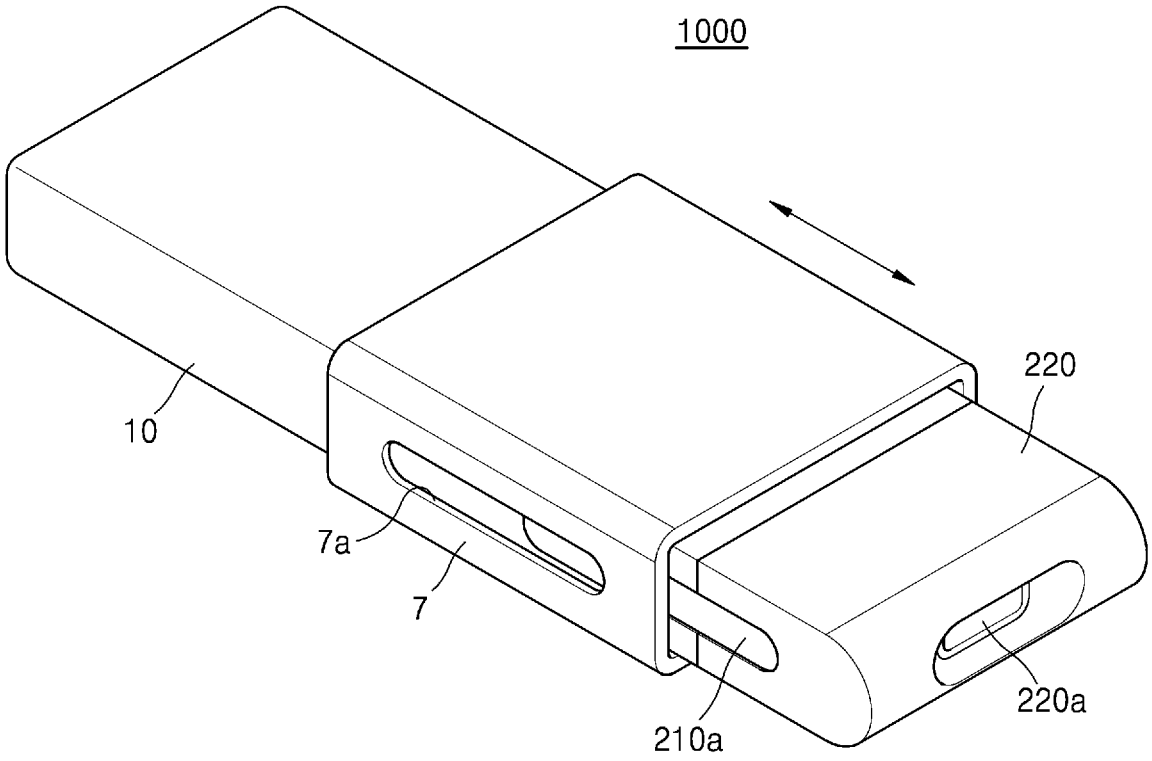
FIG. 4 is a perspective view illustrating another example operation state of the aerosol generating device according to the embodiment illustrated in FIG. 2.

FIG. 4 is a perspective view of another example operating state of the aerosol generating device according to the embodiment illustrated in FIG. 2.

In FIG. 4, the operating state is shown in which the slider 7 is at a position where the end of the mouthpiece 220 of the cartridge coupled to the main body 10 is exposed to the outside. In this state, the user may put the mouthpiece 220 into his or her mouth and inhale aerosol discharged through the discharge hole 220*a* of the mouthpiece 220.

Even when the slider 7 is at the position where the end of the mouthpiece 220 is exposed to the outside, the protruding window 21*a* of the cartridge is exposed to the outside through the elongated hole 7*a* of the slider 7, and thus, the user may visually check the remaining amount of aerosol generating material contained in the cartridge.

Figure 5:
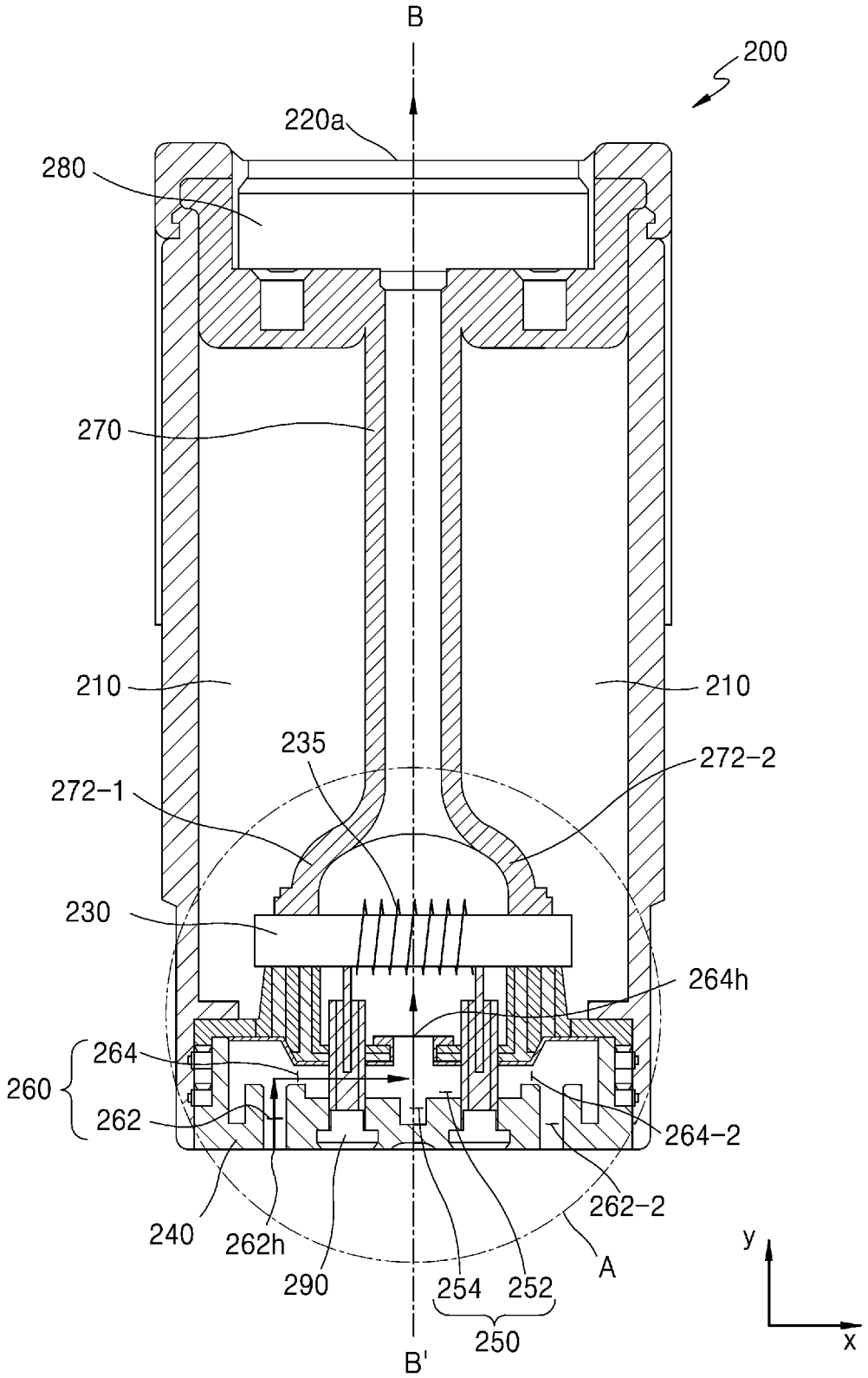
FIG. 5 is a cross-sectional view of a cartridge of an aerosol generating device according to embodiments.
Figure 6:
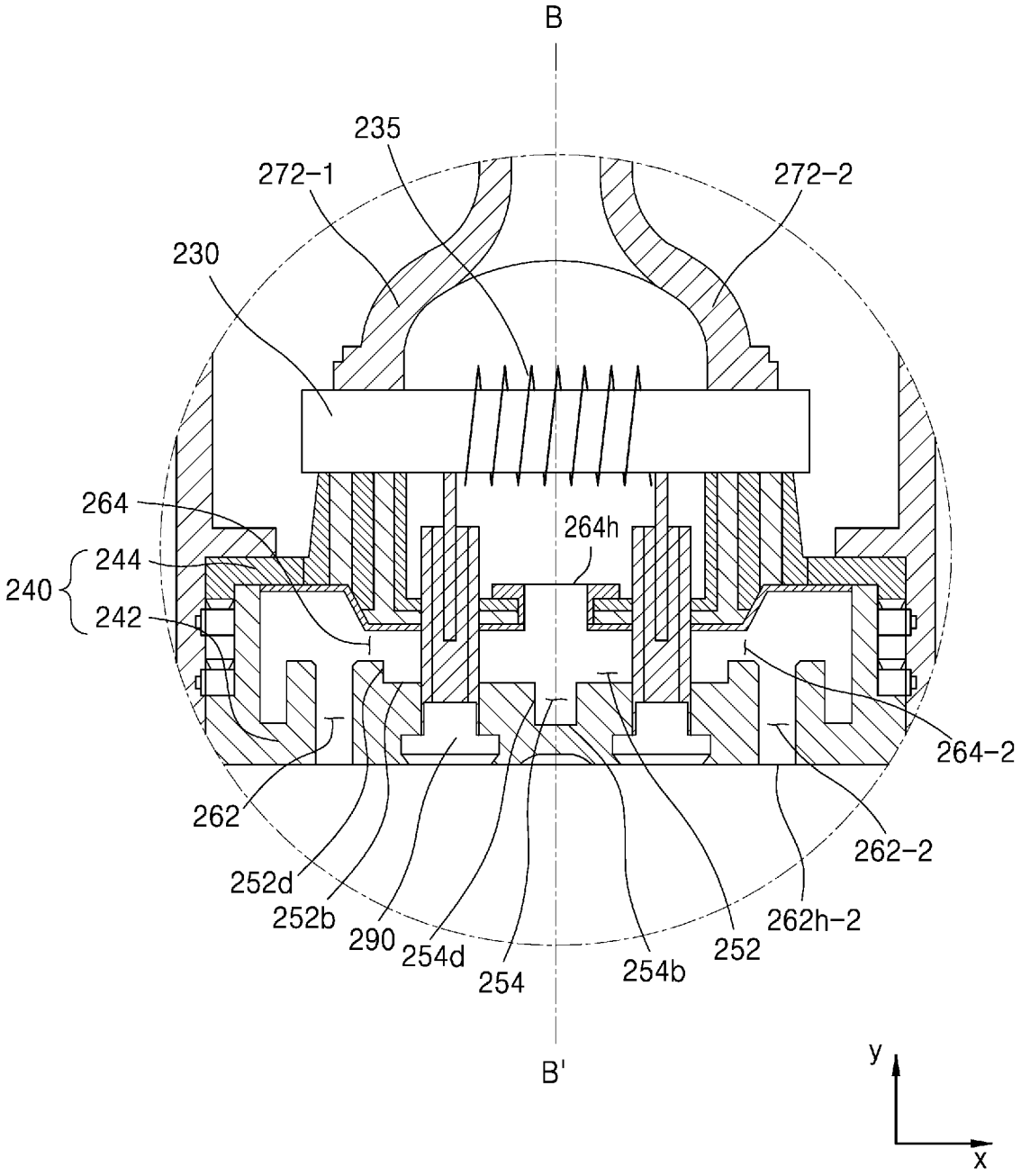
FIG. 6 is an enlarged view of a region of FIG. 5.
Figure 7:
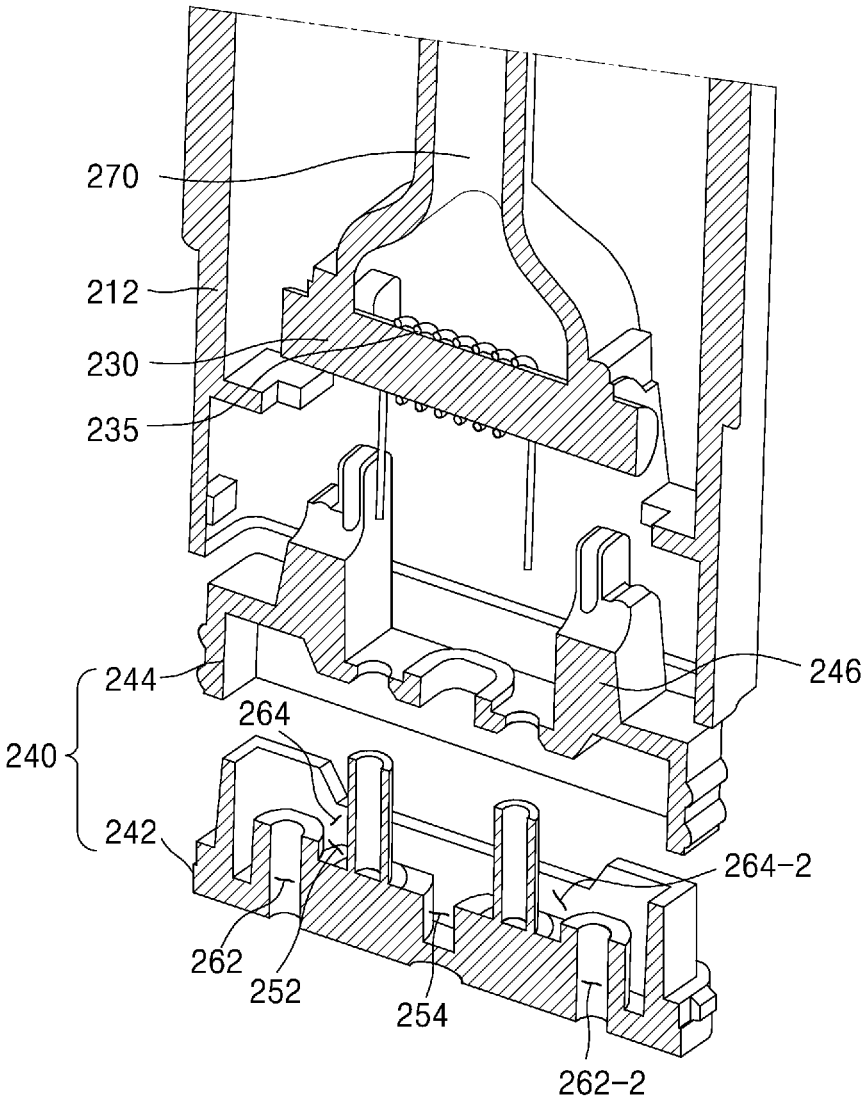
FIG. 7 is an exploded perspective view of the cartridge of FIG. 5.

FIG. 5 is a cross-sectional view of a cartridge of an aerosol generating device according to an embodiment. FIG. 6 is an enlarged view of the "A" region of FIG. 5. FIG. 7 is an exploded perspective view of the cartridge of FIG. 5.

Referring to FIGS. 5 and 6, a cartridge 200 may include a storage 210, a wick 230, an aerosol discharge passage 270, and a cap 240. The storage 210 may store an aerosol generating material. The cap 240 may be coupled to an end of the storage 210 to seal the aerosol generating material. The wick 230 may be connected to the storage 210 to deliver the aerosol generating material stored in the storage 210 to a heating element 235. The heating element 235 may heat the aerosol generating material of the wick 230 to vaporize aerosol. The vaporized aerosol may be discharged through the aerosol discharge passage 270.

Throughout the specification, a y-axis direction indicates a direction in which the aerosol discharge passage 270 extends and in which the aerosol is discharged along the aerosol discharge passage 270. In general, the y-axis direction corresponds to a proximal direction that approaches a user. An opposite direction to the y-axis direction may correspond to the direction of gravity. However, when an aerosol generating device is inclined according to the use form of the aerosol generating device, the opposite direction may not necessarily match the direction of gravity. In the specification, the y-axis direction may be referred to as an upward direction, and the opposite direction to the y-axis direction may be referred to as a downward direction.

An extension direction of x-axis may be a direction crossing an extension direction of y-axis, and the extension direction of the x-axis and the extension direction of the y-axis may be perpendicular to each other.

The storage 210 may include an outer wall and an empty space surrounded by the outer wall. The aerosol generating material may be stored in the empty space of the storage 210. The outer wall of the storage 210 may be a housing forming an exterior of the cartridge 200.

An opening may be formed in a lower end of the storage 210. The cap 240 may be coupled to the opening of the lower end of the storage 210, and the storage 210 and the cap 240 may form a space for storing the aerosol generating material. After the aerosol generating material is injected into the storage 210 through the opening when the storage 210 is separated from the cap 240, the cap 240 may be coupled to the storage 210 to seal the opening. As the storage 210 is sealed, the aerosol generating material is prevented from leaking out of the storage 210.

According to an embodiment, an opening may be formed at an upper end of the storage 210. In this case, the cap 240 may be coupled to the opening at the upper end of the storage 210, and the storage 210 and the cap 240 may form a space for storing the aerosol generating material.

The storage 210 may be manufactured in various shapes. According to an embodiment, the storage 210 may have a shape such as a cylindrical or rectangular parallelepiped shape extending along the y-axis.

The storage 210 may be a shape that surrounds the aerosol discharge passage 270. In this case, the storage 210 may have the height (i.e., length in the y-axis direction) corresponding to a length of the aerosol discharge passage 270.

The wick 230 may be connected to the storage 210 and deliver the aerosol generating material from the storage 210 to the heating element 235. The wick 230 may be hygroscopic fiber that absorbs an aerosol generating material in the state of a liquid or a gel. The wick 230 may transport the aerosol generating material by absorbing the aerosol generating material via its end connected to the storage 210. Alternatively, according to an embodiment, the wick 230 may be a thin tube shape and transport the aerosol generating material via an inside of the tube using a capillary phenomenon.

The shape of the wick 230 may include various shapes. For example, the wick 230 is an elongated shape that extends in the x-axis direction.

Both ends or one end of the wick 230 may be connected to the storage 210. The connection between the wick 230 and the storage 210 indicates that the aerosol generating material may be discharged from the storage 210 along the wick 230. The aerosol generating material in the storage 210 is prevented from leaking out of the storage 210 without passing through the wick 230.

The heating element 235 may heat the aerosol generating material transported via the wick 230, and when a heating temperature becomes higher than or equal to a vaporization temperature of the aerosol generating material, the aerosol generating material is vaporized to generate aerosol.

The heating element 235 is arranged in an area of the wick 230. The heating element 235 may be located on an extension line of the aerosol discharge passage 270. For example, as shown in FIG. 5, the heating element 235 may be arranged in a central area of the elongated wick 230. In other words, the heating element 235 may be located between two legs 272-1 and 272-2 of the aerosol discharge passage 270. As such, the heating element 235 may be located in a vaporization chamber formed by the aerosol discharge passage 270 and the wick 230.

The heating element 235 may be in the form of a coil surrounding the wick 230. Alternatively, the heating element 235 may transfer heat to the wick 230 while being spaced apart from the wick 230.

The aerosol discharge passage 270 provides a path through which the vaporized aerosol is discharged. The aerosol discharge passage 270 may extend in the y-axis direction, and the aerosol may move in the y-axis direction along the aerosol discharge passage 270. A mouthpiece 220 may be located at one end of the aerosol discharge passage 270, and the wick 230 and the cap 240 may be located at the other end of the aerosol discharge passage 270.

The aerosol discharge passage 270 may be surrounded by the storage 210. The aerosol generating material is stored in a space formed between the outer wall of the storage 210 and an outer wall of the aerosol discharge passage 270.

The extension line B-B' is a central line of the aerosol discharge passage 270. In other words, the extension line B-B' divides a width (i.e., a length in the x-axis direction) of the aerosol discharge passage 270 in half Here, the extension line B-B' may be located in a center of the storage 210. According to an embodiment, the storage 210 and the cartridge 200 may be symmetrical with respect to the extension line B-B'.

A lower end of the aerosol discharge passage 270 may contact the wick 230 to fix the wick 230. The lower end of the aerosol discharge passage 270 may be various shapes. For example, the lower end of the aerosol discharge passage 270 may include a first leg 272-1 and a second leg 272-2, which extend in different directions.

An upper end of the aerosol discharge passage 270 is connected to the mouthpiece 220. A width (i.e., a length in the x-axis direction) of the mouthpiece 220 may be greater than a width of the aerosol discharge passage 270. According to an embodiment, the upper end of the aerosol discharge passage 270 may be connected to a liquid overflow preventer 280, and the liquid overflow preventer 280 may be connected to the mouthpiece. A width of the liquid overflow preventer 280 may be greater than a width of the aerosol discharge passage 270. Therefore, the aerosol may move from the upper end of the aerosol discharge passage 270 to the mouthpiece 220, and droplets generated by cooling the aerosol may fall and be collected at the bottom of the liquid overflow preventer 280.

The vaporization chamber is an area where the aerosol is generated by vaporizing the aerosol generating material. For example, the vaporization chamber is a space that is surrounded by the lower end of the aerosol discharge passage 270 and the wick 230 contacting the lower end of the aerosol discharge passage 270. The heating element 235 may be arranged in the vaporization chamber. Heat generated from the heating element 235 stays in the vaporization chamber, thereby improving heating efficiency in the vaporization chamber. The aerosol vaporized in the vaporization chamber moves upwards along the aerosol discharge passage 270. Some of the aerosol may cool and re-liquefy while moving along a discharge passage, thereby forming droplets. The droplets may drop and collect in a droplet accommodation portion 250 of the cap 240.

The cap 240 may be coupled to the opening of the storage 210 to form a space for storing the aerosol generating material and seal the opening.

According to an embodiment, the cap 240 may include a sealing portion that is in close contact with an inner wall of the opening. The cap 240 may be coupled to the opening of the storage 210 by a loose fit method or an interference fit method.

The droplet accommodation portion 250 may be a recessed portion formed in the cap 240 and may accommodate the droplets in a recessed space thereof. The droplet accommodation portion 250 may include a space that is recessed downwards from a top surface of the cap 240. The droplet accommodation portion 250 may include a sidewall **252*d* and bottom walls 252*b* and 254*b*, and the bottom walls 252*b* and 254*b* are recessed downwards. In other words, the bottom walls 252*b* and 254*b* are recessed in a direction away from the mouthpiece and closer to a lower end of the cap 240**.

The droplet accommodation portion 250 may be located on the extension line B-B' of the aerosol discharge passage 270. Therefore, when the droplets generated in the aerosol discharge passage 270 fall along the extension line B-B', the droplets reach the droplet accommodation portion 250. Accordingly, as the droplets directly reach the droplet accommodation portion 250 without passing through other components, the droplet accommodation portion 250 may effectively collect the droplets.

The droplet accommodation portion 250 may include a plurality of recessed portions. For example, the droplet accommodation portion 250 may include a first recessed portion 252 recessed by a first depth and a second recessed portion 254 recessed by a second depth greater than the first depth. The first recessed portion 252 includes a sidewall **252*d* and the bottom wall 252*b* extending by the first depth, and the second recessed portion 254 includes a sidewall 254*d* and the bottom wall 254*b*** extending by the second depth.

A width (i.e., a length in the x-axis direction) of the first recessed portion 252 may correspond to a width of the lower end of the aerosol discharge passage 270. The width of the first recessed portion 252 may be greater than or substantially equal to a width of the vaporization chamber. As a result, the first recessed portion 252 may efficiently collect the droplets falling from the vaporization chamber. For example, the first recessed portion 252 may collect droplets leaking between the storage 210 and the wick 230 or falling from the vaporization chamber.

The second recessed portion 254 may be located where the droplet accommodation portion 250 meets the extension line B-B' of the aerosol discharge passage 270 (i.e., at a center of the droplet accommodation portion 250). Therefore, droplets falling along the extension line B-B' from the aerosol discharge passage 270 reach the second recessed portion 254.

A width of the second recessed portion 254 may be smaller than a width of the first recessed portion 252. The width of the second recessed portion 254 may correspond to the width of the aerosol discharge passage 270. For example, the width of the second recessed portion 254 may be substantially equal to the width of the aerosol discharge passage 270. As a result, the second recessed portion 254 may efficiently collect the droplets falling along the extension line B-B' from the aerosol discharge passage 270.

A depth of the second recessed portion 254 along the y-axis may be greater than a depth of the first recessed portion 252 along the y-axis. In other words, the second recessed portion 254 may be located farther away from the mouthpiece than the first recessed portion 252. Since a distribution amount of droplets is largest on the extension line B-B' of the aerosol discharge passage 270 in the vaporization chamber, the second recessed portion 254 may be recessed by the second depth to secure a space for accommodating a large amount of droplets. Therefore, the droplet accommodation portion 250 may effectively collect droplets via the second recessed portion 254 on the extension line B-B' to accommodate a large amount of droplets and may accommodate droplets generated in an entire area of the vaporization chamber via the first recessed portion 252.

Also, when the first recessed portion 252 is recessed downwards by the first depth or more, rigidity of the cap 240 may be weakened. Therefore, the droplet accommodation portion 250 may be recessed to the extent that the rigidity of the cap 240 is maintained properly.

An air inflow passage 260 through which external air flows may be formed in the cap 240. The air inflow passage 260 is a passage of an empty space formed in the cap 240.

The air inflow passage 260 may include an inlet 262*h* into which the external air is introduced an outlet 264*h* through which the external air is discharged from the cap 240 and enters the vaporization chamber, and a first path 262 and a second path 264 that connect the inlet 262*h* and the outlet 264*h*.

The inlet 262*h* is formed in a lower surface of the cap 240. The inlet 262*h* may be located apart from the extension line B-B'. Therefore, droplets falling from the aerosol discharge passage 270 may be prevented from penetrating the inlet 262*h* and being mixed with the external air entering through the inlet 262*h*.

The first path 262 may introduce the external air in the y-axis direction.

Since the first recessed portion 252 is recessed by the first depth, the first recessed portion 252 is located below an exit of the first path 262. Therefore, the first path 262 may introduce the external air above the bottom wall 252*b* of the first recessed portion 252. In other words, the first path 262 may introduce the external air to a point spaced apart from the bottom wall 252*b* of the first recessed portion 252 in the y-axis direction. One end of the first path 262 extending into the cartridge 200 may be spaced apart from the bottom wall 252*b* in an extension direction of the aerosol discharge passage 270. Therefore, droplets accommodated in the first recessed portion 252 may be prevented from flowing into the first path 262 by a step difference of the first depth.

The second path 264 may introduce the external air passing through the first path 262 along the x-axis. In other words, the second path 264 may introduce the external air in a different direction than the first path 262. The inlet 262*h* may be spaced apart from the extension line B-B' by the second path 264 (i.e., by a length of the second path 264).

In an embodiment, a plurality of inlets 262*h* may be provided and connected to a plurality of second paths 264. Also, a plurality of second paths 264 may be connected to the plurality of first paths 262.

The plurality of inlets 262*h* may be arranged on both sides of the extension line B-B'. The inlet 262*h* may include a first inlet 262*h* and a second inlet 262*h*-2, which are located on opposite sides of the extension line B-B'. Here, the droplet accommodation portion 250 may be arranged between the first inlet 262*h* and the second inlet 262*h*-2.

The external air introduced through the first inlet 262*h* may pass through the first path 262 and the second path 264 as described above. Similarly, the external air introduced through the second inlet 262*h*-2 move in the y-axis direction through a third path 262-2, then move in the x-axis direction through a fourth path 264-2.

The external air passing through the second path 264 and the external air passing through the fourth path 264-2 may be merged and discharged from the cap 240 through the outlet 264*h* to enter the vaporization chamber.

Referring to FIG. 7, the cap 240 may include an upper cap portion 244 and a lower cap portion 242. The upper cap portion 244 and the lower cap portion 242 are coupled to each other and may be detachable from each other. As the upper cap portion 244 and the lower cap portion 242 may be coupled to each other, the air inflow passage 260 may be formed in the cap 240.

The upper cap portion 244 may be coupled to the lower cap portion 242 to form the second path 264 and the fourth path 264-2. The upper cap portion 244 may be connected to an end of the heating element 235. A protrusion 246 on which the end of the heating element 235 is fixed may be formed at the upper cap portion 244.

The lower cap portion 242 may include the inlet 262*h*, the first path 262, and the third path 262-2. The first path 262 and the third path 262-2 may extend to a top inner surface of the upper cap portion 244.

The cartridge 200 may include the terminal 290 that transfers power from the battery 1100 to the heating element 235. When the cartridge 200 is coupled to the battery 1100, the terminal 290 may be electrically connected to the battery 1100. Both ends of the heating element 235 may extend to be electrically connected to the terminal 290.

The terminal 290 may be arranged at a lower end of the cartridge 200. For example, the terminal 290 may be arranged in the lower cap portion 242. The terminal 290 may be arranged under the first recessed portion 252. The both ends of the heating element 235 may be connected to the terminal 290 by passing through the upper cap portion 244 and the first recessed portion 252. Here, the both ends of the heating element 235 may be surrounded by an insulator such that droplets of the first recessed portion 252 do not contact the both ends of the heating element 235. Alternatively, when the droplets are nonconductive, the both ends of the heating element 235 do not need to be insulated.

At least one of the components, elements, modules or units (collectively "components" in this paragraph) represented by a block in the drawings such as the controller 1600 and the user interface 1400 in FIG. 1, may be embodied as various numbers of hardware, software and/or firmware structures that execute respective functions described above, according to an example embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above example embodiments may be implemented in algorithms that execute on one or more processors. Furthermore, the components represented by a block or processing steps may employ any number of related art techniques for electronics configuration, signal processing and/or control, data processing and the like.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is defined by the appended claims rather than by the foregoing description, and all differences within the scope of equivalents thereof should be construed as being included in the present disclosure.

What is claimed is:

1. A cartridge comprising:

a storage configured to store an aerosol generating material;

a heating element configured to generate aerosol by heating the aerosol generating material;

an aerosol discharge passage extending in a first direction and defining an extension line on which the aerosol discharge passage is centered, the aerosol discharge passage being configured to discharge the aerosol generated by the heating element out of the cartridge in the first direction;

a cap coupled to one end of the storage to seal the storage; and a droplet accommodation portion formed in the cap and located on the extension line, the droplet accommodation portion being configured to accommodate droplets formed from the aerosol generated by the heating element.

2. The cartridge of claim 1, wherein the cap comprises an air inflow passage configured to introduce external air into the cartridge through at least one inlet, and wherein the at least one inlet is spaced apart from the extension line of the aerosol discharge passage.

3. The cartridge of claim 2, wherein the air inflow passage comprises a first path introducing the external air into the cartridge in the first direction and a second path directing the external air within the first path in a second direction different from the first direction.

4. The cartridge of claim 3, wherein the droplet accommodation portion comprises a sidewall and a bottom wall, and wherein one end of the first path extending into the cartridge is spaced apart from the bottom wall in the first direction.

5. The cartridge of claim 2, wherein the at least one inlet is arranged on both sides of the extension line.

6. The cartridge of claim 1, wherein the droplet accommodation portion comprises a first recessed portion recessed by a first depth in a third direction opposite the first direction to accommodate the droplets.

7. The cartridge of claim 6, wherein the droplet accommodation portion further comprises a second recessed portion recessed by a second depth in the third direction to accommodate the droplets, the second depth being greater than the first depth.

8. The cartridge of claim 7, wherein the second recessed portion is formed at a center of the droplet accommodation portion.

9. The cartridge of claim 7, wherein a first width of the first recessed portion corresponds to a width of a lower end of the aerosol discharge passage, and a second width of the second recessed portion is smaller than the first width of the first recessed portion.

10. The cartridge of claim 1, wherein the droplet accommodation portion defines an open space in the cap to accommodate the droplets.

11. The cartridge of claim 1, wherein the cap is separable from the one end of the storage to thereby provide an opening into the storage.

12. An aerosol generating device comprising:

a cartridge comprising:

a storage configured to store an aerosol generating material, a heating element configured to generate aerosol by heating the aerosol generating material, an aerosol discharge passage extending in a first direction and defining an extension line on which the aerosol discharge passage is centered, the aerosol discharge passage being configured to discharge the aerosol generated by the heating element out of the cartridge in the first direction, a cap configured to seal the storage, and a droplet accommodation portion formed in the cap and located on the extension line, the droplet accommodation portion being configured to accommodate droplets formed from the aerosol generated by the heating element;

a battery configured to supply power to the cartridge; and a controller configured to control the power supplied by the battery to the cartridge.

13. The aerosol generating device of claim 12, wherein the cap comprises an air inflow passage introducing external air into the cartridge through an inlet, and wherein the inlet is spaced apart from the extension line of the aerosol discharge passage.

14. The aerosol generating device of claim 12, wherein the droplet accommodation portion comprises a first recessed portion recessed by a first depth in a third direction opposite the first direction, and a second recessed portion recessed by a second depth in the third direction, the second depth being greater than the first depth.

* * * * *